US006076545A

United States Patent [19]

Cooper

[11] Patent Number: 6,076,545

[45] Date of Patent: Jun. 20, 2000

[54] FIRE-CONTROL SPRINKLER SYSTEM RISER MEANS

[76] Inventor: Michael S. Cooper, 105 W. Jomax Rd., Phoenix, Ariz. 85027

[21] Appl. No.: 08/840,421

[22] Filed: Apr. 29, 1997

Related U.S. Application Data

[63] Continuation-in-part of application No. 08/604,732, Feb. 21, 1996, abandoned.

[51] Int. Cl.[7] ..... A62C 35/60; A62C 35/68

[52] U.S. Cl. ..... 137/360; 137/552; 137/561 A; 169/16; 200/81.9 R

[58] Field of Search ..... 137/360, 551, 137/557, 559, 561 A, 561 R, 552; 73/861.74, 861.76; 169/16, 17; 200/81.9 R

[56] References Cited

U.S. PATENT DOCUMENTS

| | | | |
|---|---|---|---|
| 2,203,138 | 6/1940 | Ginnaty | 169/16 |
| 2,287,633 | 6/1942 | Newcom | 137/360 X |
| 2,740,858 | 4/1956 | Euler | 200/81.9 R |
| 2,762,387 | 9/1956 | Orwin | 137/360 |
| 3,126,453 | 3/1964 | Kmiecik | 200/81.9 R |
| 3,407,842 | 10/1968 | Zahuranec | 137/561 R |
| 3,448,442 | 6/1969 | Hube | 200/81.9 R |
| 3,729,604 | 4/1973 | Groffetal | 200/81.9 R |
| 3,760,842 | 9/1973 | Mikiya | 137/561 R |
| 3,845,259 | 10/1974 | Spurr | 200/81.9 R |
| 4,454,768 | 6/1984 | Nansel | 200/81.9 R |
| 4,725,700 | 2/1988 | Zoludow | 200/81.9 R |
| 4,782,333 | 11/1988 | Merchant | 200/81.9 R |
| 5,029,606 | 7/1991 | Kuhlthau, Jr. | 137/360 |
| 5,099,925 | 3/1992 | Glidden et al. | 169/17 |

FOREIGN PATENT DOCUMENTS

| | | | |
|---|---|---|---|
| 593394 | 11/1977 | St. Helena | 1137 360 |

*Primary Examiner*—John Rivell
*Attorney, Agent, or Firm*—Martin L. Stoneman

[57] ABSTRACT

This invention provides a fire-control sprinkler system riser for a residence, including a unitary manifold for porting to system components. The longitudinal manifold has pipe threads on its ends to connect to an inlet water pipe and an outlet sprinkler system; and it has ports all to one side of the manifold for mounting the riser system components in the following order from inlet to outlet: flow switch means; test and drain valve means; pressure gauge means; and relief valve means. On the other side of the manifold are support connections, as for attachment to a beam of the residence. The manifold may be connected facing either way, i.e., left support or right support, and it has indicia on both manifold facing sides for indicating flow direction and port identifications to a user from either side. Dimensions provide high efficiency in use of space, etc.

41 Claims, 4 Drawing Sheets

FIG. 8
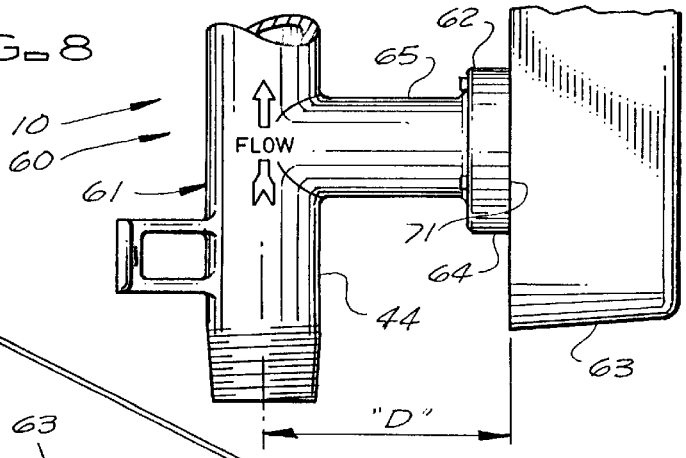
FIG. 9
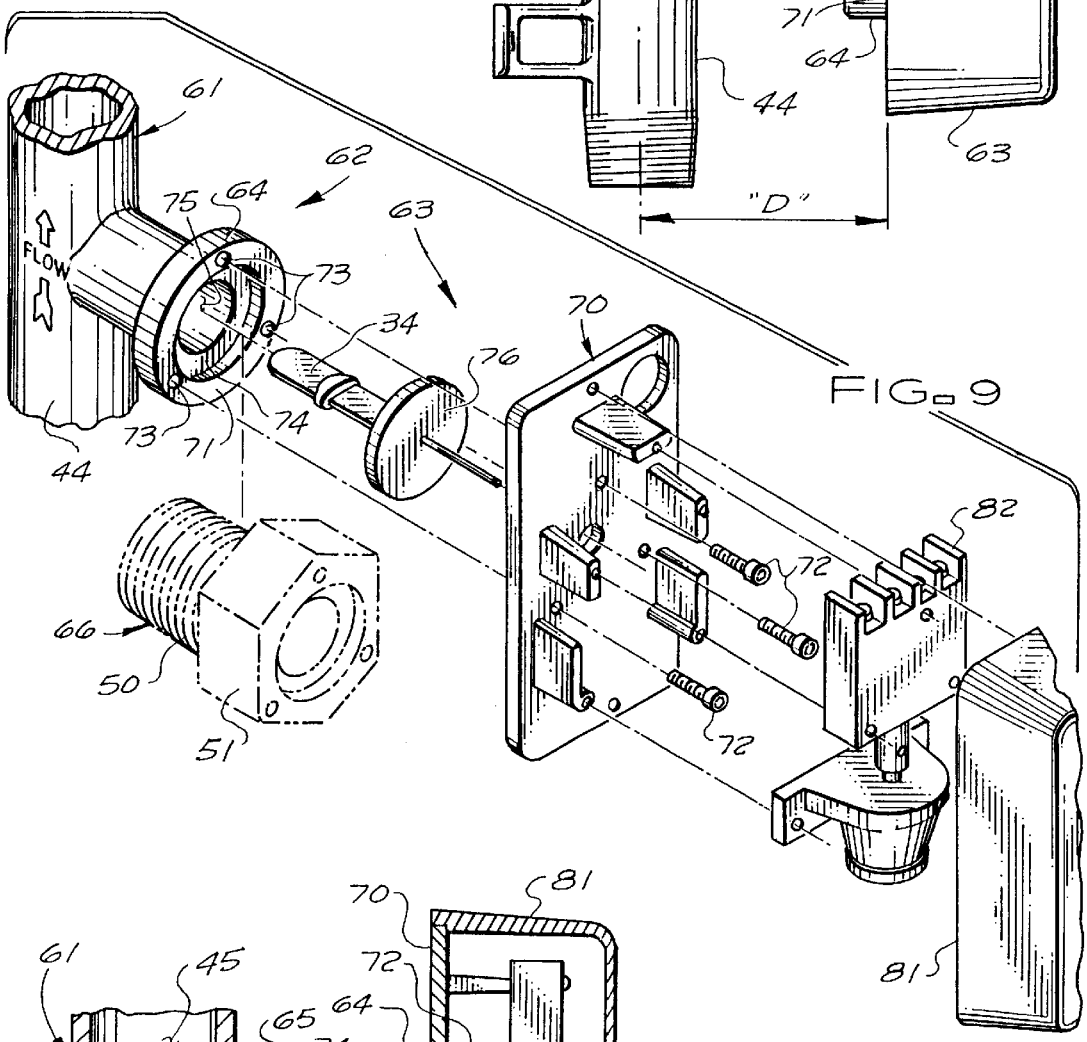
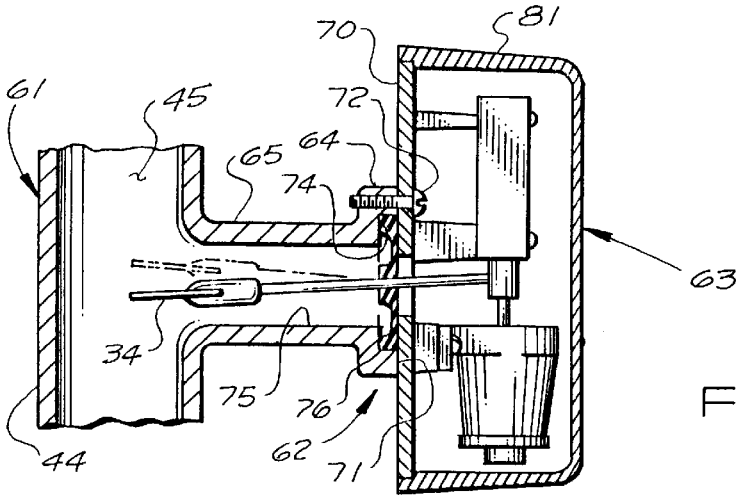
FIG. 10

FIRE-CONTROL SPRINKLER SYSTEM RISER MEANS

This application is a C-I-P of application Ser. No. 08/604,732 filed Feb. 21, 1996, now abandoned.

BACKGROUND OF THE INVENTION

1. Field of the Invention

This invention relates to providing a fire-control sprinkler system riser means. More particularly, this invention concerns a such a sprinkler system riser means including an efficient unitary manifold system for porting to system components and support stability.

2. Description of the Prior Art

Typically, in plumbing fire-control sprinkler connections to a building water supply, the lower end of a riser pipe will be connected to a water supply pipe and the upper end will be connected to an outlet pipe to the sprinkler system, the riser pipe being stabilized in position by connecting it to the building structure, as by tying it to a beam. And certain useful components will be attached by porting to the riser pipe, usually the following: a flow switch to ascertain whether or not there is a flow in the riser pipe to the fire sprinkler system and to relay this information where needed, as to fire departments; a test and drain valve to open the riser pipe to a drain for the purposes of testing, bleeding, etc.; a pressure gauge to deliver a read out of the water pressure in the riser pipe; and a relief valve to open the riser pipe to a drain in the event a certain (usually settable) water pressure is exceeded in the riser pipe.

To avoid doing the above as on-the-spot plumbing labor, it has been attempted for commercial uses to pre-make a steel, epoxy-coated riser manifold containing ports for the component attachments. Then such manifold, with or without components attached, may be plumbed on site for connection to a water inlet and sprinkler outlet. But there are still many unsolved problems, especially for residential uses where the sprinkler system is part of a drinkable water system. Manifolds for riser purposes, especially for residential risers, are not available with minimum lengths and costs, with efficient arrangement of ports and of pipe threads for component connection, with efficient means for supporting the riser in connecting to a structure, with abilities for safe and efficient use in all locations in any direction, etc.

Additionally, flow switches are normally manufactured for connection plumbing by way of pipe threads, usually tapered pipe threads; however, there are many inefficiencies in such a connection. Eliminating such a connection would permit elimination of: an unnecessary joint which may be a point of current or future leakages; a large brass adapter fitting which is supplied with the flow switch for threaded pipe mounting; the use and need for thread sealing materials such as Teflon tape or pipe dope; the need for a large size wrench or pipe wrench (To tighten a 1" N.P.T. tapered fitting requires a large amount of torque which in turn puts a great stress upon the entire manifold and pipe system. This stress could work loose the mounting brackets, screws etc.); and the need to carefully orient the final positioning of the flow switch when rotating (tightening) the switch onto a threaded port for proper switch operation. Thus, a threaded attachment means, utilizing tapered pipe thread, provides a potential point of leakage, additional labor to assemble, unnecessary componentry and added cost. There is a need in the industry for an improved method and product for flow switch connection and for lower overall cost.

OBJECTS OF THE INVENTION

A primary object of the present invention is to fulfill the above-mentioned needs by the provision of a sprinkler riser system having an efficient unitary manifold construction. A further object is to provide an improved method of component connection. A further primary object of the present invention is to provide such a manifold system which is efficient and inexpensive, as well as overcoming the other above-mentioned problems. Other objects of this invention will become apparent with reference to the following invention descriptions.

SUMMARY OF THE INVENTION

According to a preferred embodiment of the present invention, this invention provides a riser manifold unitary means for connecting a water supply pipe of a structure to a sprinkler system pipe of such structure comprising, in combination: longitudinal pipe means for guiding water flow from such water supply pipe to such sprinkler system pipe; extending transversely from such longitudinal pipe means and all aligned in parallel relation along a first side of such longitudinal pipe means, multiple attachment means for attaching sprinkler system components; wherein such multiple attachment means comprise pipe threads; and, further, extending transversely from such longitudinal pipe means along a second side of such longitudinal pipe means about 180 degrees opposed to such first side, support means for assisting attachment of such riser manifold unitary as means to such structure. This invention further provides such a riser manifold unitary means wherein such multiple pipe thread attachment means comprise ports for attachment to such longitudinal pipe means of at least three of the following such system components: flow switch means for monitoring delivery of such water flow to sprinklers of such sprinkler system; test and drain valve means for testing and draining such sprinkler system; pressure gauge means for monitoring water pressure in such sprinkler system; and relief valve means for providing over-pressure relief for such sprinkler system. And, it further provides such a riser manifold unitary means wherein such multiple attachment means comprise ports for attachment to such longitudinal pipe means of at least the following such system components: flow switch means; test and drain valve means; pressure gauge means; and relief valve means.

Additionally, according to a preferred embodiment of this invention, this invention provides such a riser manifold unitary means wherein such longitudinal pipe means comprises: a first pipe thread at a first end of such longitudinal pipe means for assisting connection to an inlet from such water supply pipe; and a second pipe thread at a second end of such longitudinal pipe means for assisting connection to an outlet to such sprinkler system pipe. Also, it provides such a riser manifold unitary means wherein such multiple attachment means comprise ports for attachment to such longitudinal pipe means of the following such system components, in the following order with respect to a direction from such first pipe thread to such second pipe thread: flow switch means; test and drain valve means; pressure gauge means; and relief valve means; and, further wherein a such attachment means of a such port for attachment of a such system component, test and drain valve means, comprises an external pipe thread.

Yet further, this invention provides such a riser manifold unitary means wherein: such longitudinal pipe means is about sixteen inches long; such first and second pipe threads are external pipe threads preferably sized one-inch N.P.T.; such port for such flow switch means comprises a center about three inches from such first end of such longitudinal pipe means, and internal pipe threads sized one inch N.P.T.; such port for such test and drain valve means comprises a center about eight inches from such first end of such longitudinal pipe means, and external pipe threads sized one-half inch N.P.T.; such port for such pressure gauge means comprises a center about eleven inches from such first end of such longitudinal pipe means, and internal pipe threads sized one-quarter inch N.P.T.; and such port for such relief valve means comprises a center about fourteen inches from such first end of such pipe means, and internal pipe threads sized one-half inch N.P.T.; and, further, wherein such port for flow switch means comprises no pipe thread but instead flange means for direct no-pipe-thread attachment of a such flow switch means to such riser manifold unitary means. And it even further provides such a riser manifold unitary means wherein such riser manifold unitary means is constructed essentially of a cast alloy material selected from the following group: brass, bronze, copper.

Even additionally, the present invention provides such a riser manifold unitary means further comprising: at about 90 degrees from such first side of such longitudinal pipe means, first indicia indicating a water flow direction and second indicia indicating port identifications; and at about 270 degrees from such first side of such longitudinal pipe means, third indicia indicating a water flow direction and fourth indicia indicating port identifications; such indicia comprising symbols raised above a surface level of such riser manifold unitary means. And it provides such a riser manifold unitary means wherein such support means comprises pedestal means including mounting flange means comprising a mounting hole for assisting attachment of such unitary means to such structure; and, further, wherein such mounting hole is slanted away at an acute angle from a direction perpendicular to such longitudinal pipe means; and, further, wherein such acute angle is about 20 degrees.

Yet even further, according to a preferred embodiment of the present invention, this invention provides a sprinkler system riser unit for supplying water from a water supply pipe of a structure to a sprinkler system pipe of such structure comprising, in combination: (1) a riser manifold unitary means comprising longitudinal pipe means for guiding water flow from such water supply pipe to such sprinkler system pipe; extending transversely from such longitudinal pipe means and aligned in parallel relation along a first side of such longitudinal pipe means, multiple pipe thread attachment means for attaching sprinkler system components; extending transversely from such longitudinal pipe means along a second side of such longitudinal pipe means about 180 degrees opposed to such first side, support means for assisting attachment of such riser manifold unitary means to such structure; at about 90 degrees from such first side of such longitudinal pipe means, first indicia indicating a water flow direction and second indicia indicating port identifications; at about 270 degrees from such first side of such longitudinal pipe means, third indicia indicating a water flow direction and fourth indicia indicating port identifications; wherein such indicia comprise symbols raised above a surface level of such riser manifold unitary means; and wherein such support means comprises pedestal means including mounting flange means comprising a mounting hole for assisting attachment of such unitary means to such structure; a first pipe thread at a first end of such longitudinal pipe means for assisting connection to an inlet from such water supply pipe; and a second pipe thread at a second end of such longitudinal pipe means for assisting connection to an outlet to such sprinkler system pipe; and (2) attached to such pipe thread attachments of such riser manifold unitary means, in the following order with respect to a direction from such first pipe thread to such second pipe thread, flow switch means, test and drain valve means, pressure gauge means; and relief valve means.

Moreover, this invention provides such a sprinkler system riser further comprising: drain connection means attached to such test and drain valve means; and a drain hose attached from a first hose attachment means of such relief valve means to a second hose attachment means of such drain connection means; wherein such first and second hose attachment means comprise external-barb-type nipples. And it provides such a sprinkler system riser further comprising: inlet means connected to such first pipe thread at such first end of such longitudinal pipe means; outlet means connected to such second pipe thread at such second end of such longitudinal pipe means; drain means connected to such drain connection means; and structure connection means connecting such mounting hole to such structure. Also, it provides such a sprinkler system riser wherein: such mounting hole is slanted about twenty degrees away from a direction perpendicular to such longitudinal pipe means; and, preferably, such structure connection means is threaded. And it further provides such a sprinkler system riser wherein: a control means for operation of such test and drain valve means is facing a direction selected from the following—about 90 degrees from such first side of such longitudinal pipe means, and about 270 degrees from such first side of such longitudinal pipe means; and a readable face of such pressure gauge is facing in the same direction as such control means.

In addition, according to a preferred embodiment thereof, this invention provides a riser manifold unitary means for connecting a water supply pipe of a structure to a sprinkler system pipe of such structure comprising, in combination: longitudinal pipe means for guiding water flow from such water supply pipe to such sprinkler system pipe; extending transversely from such longitudinal pipe means and all aligned in parallel relation along a first side of such longitudinal pipe means, multiple pipe thread attachment means for attaching sprinkler system components; extending transversely from such longitudinal pipe means along a second side of such longitudinal pipe means opposite to such first side, support means for assisting attachment of such riser manifold unitary means to such structure; at about 90 degrees from such first side of such longitudinal pipe means, first indicia indicating a water flow direction and second indicia indicating port identifications; at about 270 degrees from such first side of such longitudinal pipe means, third indicia indicating a water flow direction and fourth indicia indicating port identifications; wherein such indicia comprise symbols raised above a surface level of such riser manifold unitary means; a first pipe thread at a first end of such longitudinal pipe means for assisting connection to an inlet from such water supply pipe; a second pipe thread at a second end of such longitudinal pipe means for assisting connection to an outlet to such sprinkler system pipe; wherein such multiple pipe thread attachment means provide ports for attachment to such longitudinal pipe means of the following such system components, in the following order with respect to a direction from such first pipe thread to such second pipe thread, flow switch means, test and drain valve means, pressure gauge means, and relief valve means; wherein such multiple pipe thread attachment means comprises a male pipe thread for attachment to such test and drain valve means; wherein such support means comprises pedestal means including mounting flange means comprising a mounting hole for assisting attachment of such unitary means to such structure; and wherein such mounting hole is slanted about twenty degrees away from a direction perpendicular to such longitudinal pipe means.

Yet in addition, this invention provides such a riser manifold unitary means wherein: such longitudinal pipe means is about sixteen inches long; such first and second pipe threads are external pipe threads; such port for such flow switch means comprises a center about three inches from such first end of such longitudinal pipe means, and internal pipe threads sized one inch N.P.T.; such port for such test and drain valve means comprises a center about eight inches from such first end of such longitudinal pipe means, and external pipe threads sized one-half inch N.P.T.; such port for such pressure gauge means comprises a center about eleven inches from such first end of such longitudinal pipe means, and internal pipe threads sized one-quarter inch N.P.T.; and such port for such relief valve means comprises a center about fourteen inches from such first end of such longitudinal pipe means, and internal pipe threads sized one-half inch N.P.T. And it provides such a riser manifold unitary means wherein such riser manifold unitary means is constructed essentially of a molded plastic material.

Yet further, according to a preferred embodiment thereof, the present invention provides a riser manifold unitary means for connecting a water supply pipe of a structure to a sprinkler system pipe of such structure comprising, in combination: longitudinal pipe means for guiding water flow from such water supply pipe to such sprinkler system pipe; and, extending transversely from such longitudinal pipe means along a first side of such longitudinal pipe means, attachment means for attaching flow switch means for monitoring delivery of such water flow to sprinklers of such sprinkler system; wherein such attachment means comprises flange means for direct no-pipe-thread attachment of such flow switch means to such riser manifold unitary means; and, further, wherein such flange means comprises multiple hole means for providing attachment sites for a such flow switch means, and counterbore means for receiving a cylindrical seal for such direct no-pipe-means attachment of such flow switch means to such riser manifold means.

Furthermore, according to a preferred embodiment thereof, this invention provides, in a structure for containing water flow: longitudinal pipe means for guiding such water flow; and extending transversely from such longitudinal pipe means along a first side of such longitudinal pipe means, attachment means for attaching flow monitoring means for monitoring such water flow; wherein such attachment means comprises flange means for direct no-pipe-thread attachment of such flow monitoring means to such longitudinal pipe means.

And, even further, according to a preferred embodiment thereof, this invention provides, in a system for connecting a flow switch to a longitudinal pipe for monitoring water flow through such longitudinal pipe, such flow switch being of the type comprising a housing including a face plate, a sensing switch within such housing, a sensing paddle outside such housing and connected by a connector member through such face plate to such sensing switch, screw attachments for connecting such face plate to a flange member, and a cylindrical seal member, co-axial with such sensing paddle and encircling such connector member, for sealing such face-plate-to-flange connection, the steps of: providing an attachment pipe extending transversely from such longitudinal pipe along a first side of such longitudinal pipe, such attachment pipe comprising, at an outer end of such attachment pipe, a flange, comprising a cylindrical counterbore co-axial with such attachment pipe, for direct no-pipe-thread attachment of such flow switch to such attachment pipe in such manner that such flow switch may monitor water flow through such longitudinal pipe; disassembling such flow switch to remove such face plate, such sensing paddle and connector member, and such seal member; inserting such sensing paddle through such counterbore into such attachment pipe in such manner that such seal member rests essentially within such counterbore; connecting such face plate to such flange with such screw attachments in such manner as to seal such face-plate-to-flange connection with such sensing paddle in place for such monitoring and permit such connector member to pass through such face plate in position for connection to such sensing switch; reconnecting such connector member to such sensing switch; and reconnecting such housing to reassemble such flow switch.

BRIEF DESCRIPTION OF THE DRAWINGS

FIG. 8 is an elevation view of the lower portion (at the flow switch attachment location) of yet another alternate embodiment of a riser manifold unitary means of the present invention.

FIG. 9 is a perspective exploded view of a flow switch and its attachment means to the alternate embodiment of the riser manifold unitary means of FIG. 8.

FIG. 10 is a cross-sectional elevation view of a flow switch and its attachment means to the alternate embodiment of the riser manifold unitary means of FIG. 8.

DETAILED DESCRIPTION OF A PREFERRED EMBODIMENT AND THE BEST MODE OF PRACTICE

Figure 1:
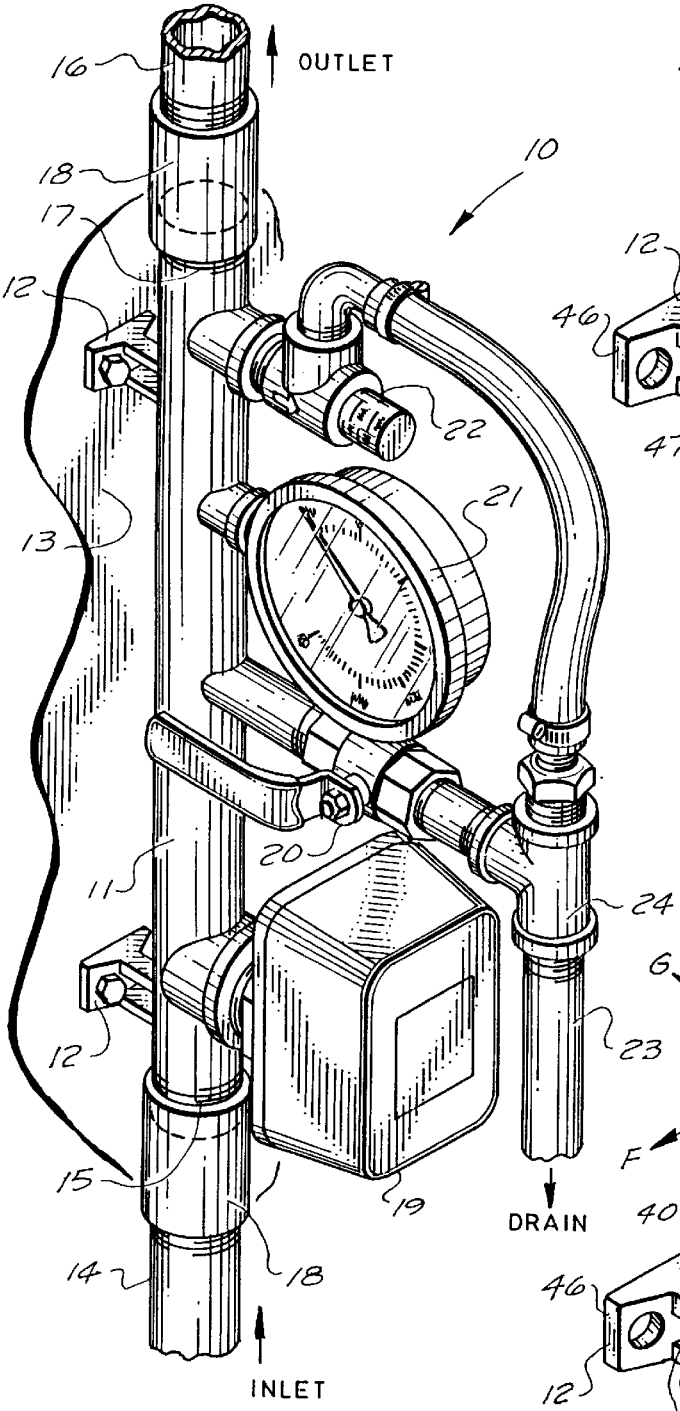
FIG. 1 is a perspective view of a the preferred embodiment of the sprinkler system riser unit of the present invention connected in a residential structure.
Figure 2:
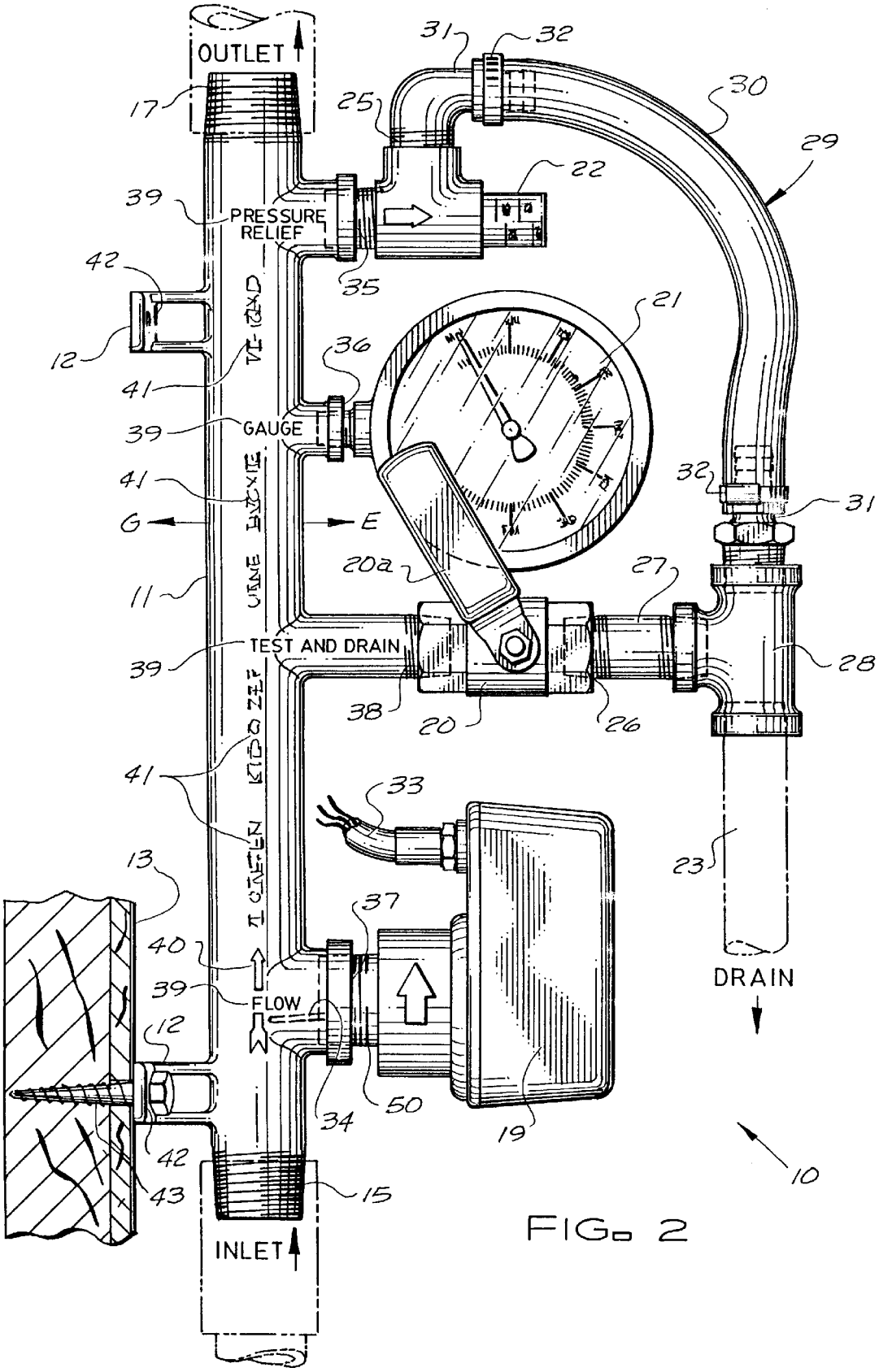
FIG. 2 is an elevation view of the illustrated sprinkler system riser unit.

Shown in FIG. 1 is a perspective view of a preferred embodiment of the sprinkler system riser unit of the present invention connected in a residential structure; and FIG. 2 is an elevation view of the illustrated sprinkler system riser unit. With particular reference to FIG. 1, the riser unit 10 is a component of a water sprinkler system for a residential fire protection system. The riser unit 10 includes components used for monitoring delivery of water to the sprinklers (not shown), monitoring water pressure, providing system overpressure relief, and testing and draining the water sprinkler system. Riser unit 10 incorporates a riser manifold unitary means embodied by the one-piece manifold 11 to assist in making connections to the above-mentioned components as well as water system connections, all as hereinafter described.

Manifold 11 incorporates support means (for assisting attachment of the riser manifold unitary means to the structure) embodied by two pedestals 12 for stabilizing of the riser unit 10 by attachment of the riser unit 10 to a convenient location of the residence's structure (such as beam 13, as shown). The riser unit 10 connects the residence's water piping to the sprinkler system by two connections onto manifold 11: to connect to inlet means embodied by water supply pipe 14 and standard pipe coupling 18 at the inlet 15; and to connect to outlet means embodied by sprinkler plumbing pipe 16 and standard pipe coupling 18 at the outlet 17. Other suitable fittings may be used. Manifold 11 includes pipe thread attachment locations (on its side facing direction E, as shown, see especially FIGS. 4 and 6) for system components as illustrated: flow switch means embodied by flow switch 19; test and drain valve means embodied by test and drain valve 20; pressure gauge means embodied by pressure gauge 21; and relief valve means embodied by relief valve 22. There are also connections to riser unit 10 of a drain 23 at drain connection means embodied by T-fitting 24 and electrical connection wiring 33 (see FIG. 2) to the flow switch 19.

Figure 3:
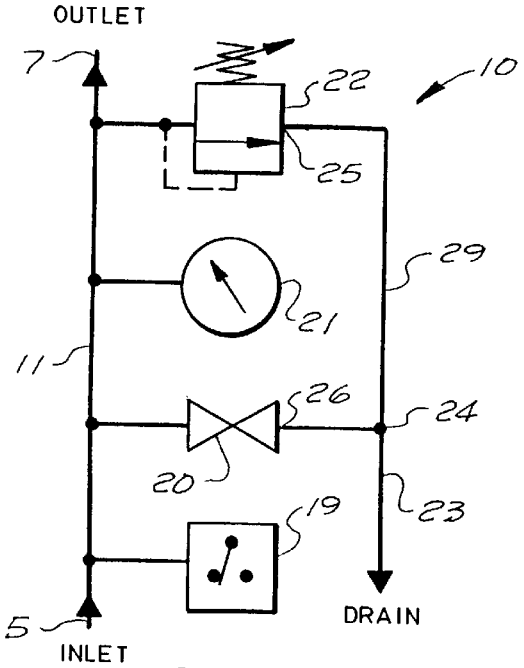
FIG. 3 is a schematic diagram of the illustrated sprinkler system riser unit.

With particular reference to FIG. 2 and the schematic diagram of FIG. 3, the riser unit 10 includes means for conveniently grouping, connecting and securely mounting various components of a fire prevention water sprinkler system. Although water sprinkler systems are custom tailored for each application with a varying quantity of sprinkler heads and a varying layout of interconnecting plumbing, the system components of riser unit 10 remain reasonably consistent with most applications; and the teachings of the present invention will apply even if in a particular application ports for only three of the described system components are cast into manifold 11. The functioning of all the preferred components is as follows. A pressure gauge 21 indicates the pressure within the system and is monitored for indication that ample pressure is available in the event that the sprinklers will be activated. Over-pressurization of a closed system can occur, from thermal expansion or other reasons, and relief valve 22 is provided as a prevention against excess pressure. Relief valve 22 is variably adjustable and limits the water pressure within the entire sprinkler system to the pressure at which the relief valve 22 is set. In the event that relief valve 22 opens to release water, the water exits from outlet port 25 of relief valve 22. When installing, testing, bleeding or draining the system, test and drain valve 20 is used to vent or open the system to atmospheric pressure. Shown is a conventional lever-operated manual ball valve which, when actuated, releases water from the system. Connected to its outlet 26 are fittings to which a drain 23 will be attached at time of installation. Pipe nipple 27 and pipe tee 28 provide this connection as well as incorporating a means for receiving a relief line 29 from the outlet port 25 of relief valve 22. Relief line 29 consists of us flexible hose 30, barbed hose-connection fittings 31 at outlet port 25 and pipe tee 28, and hose clamps 32. This arrangement provides an easy-disconnect structure for the hose 30 attached from a first hose attachment fitting of relief valve 22 to a second hose attachment fitting 31 of drain-connection pipe tee 28 in that fittings 31 comprise external-barb-type nipples, all as shown.

Also incorporated on riser unit 10 is a flow switch 19 which utilizes its included sensing paddle 34 to monitor water flow within the interior of manifold 11. In the event of sprinkler activation (or testing), water flow through riser unit 10 is recognized by flow switch 19 which activates its integral electrical contacts and sends an electrical signal through attached wiring 33. This electrical signal may typically then be used to actuate an alarm or bell within the residence and may additionally be used to notify a fire station.

To functionally connect these components together, manifold 11 is provided. Manifold 11 is a one-piece casting with standard pipe thread connections at inlet 15, outlet 17, relief valve port 35, pressure gauge port 36, flow switch port 37, and test and drain port 38. The two pedestals 12 for mounting are cast integrally with mounting holes 42 provided. Illustrated is how mounting holes 42 of pedestals 12 might be attached with structure connection means embodied by screws 43 to a sturdy portion of the residence structure 13. The longitudinal pipe means for guiding water flow from the water supply pipe to the sprinkler system pipe is embodied by run 44 which extends from a first end 15*a* at inlet 15 and a second end 17*a* at outlet 17, both of which outlets have standard male, external pipe threads sized one inch N.P.T. Located on run 44 (on its side facing direction F, see especially FIG. 4), at about 90 degrees from the first-mentioned side (facing direction E, hereinafter sometimes called side E) of run 44, are first indicia, embodied by arrow 40, indicating a water flow direction, and second indicia, embodied by port identifications 39, indicating port identifications. Also located on run 44 (on its side facing in direction H, sometimes hereinafter called side H), at about 270 degrees from first side E of run 44, are third indicia (similar to said first indicia) indicating a water flow direction and fourth indicia (similar to said second indicia) indicating port identifications. All these just-mentioned indicia comprise symbols raised above a surface level of run 44. Port identifications 39 are worded PRESSURE RELIEF, GAUGE, TEST & DRAIN, and FLOW. Port identification 39 located at flow switch port 37 additionally has adjacent to it arrow 40 indicating direction of water flow within the manifold 11, as shown. Additional indicia 41 cast into manifold 11 might include trade name and mark, part numbering, patent numbering, manufacturer, and phone number, etc.

Figure 4:
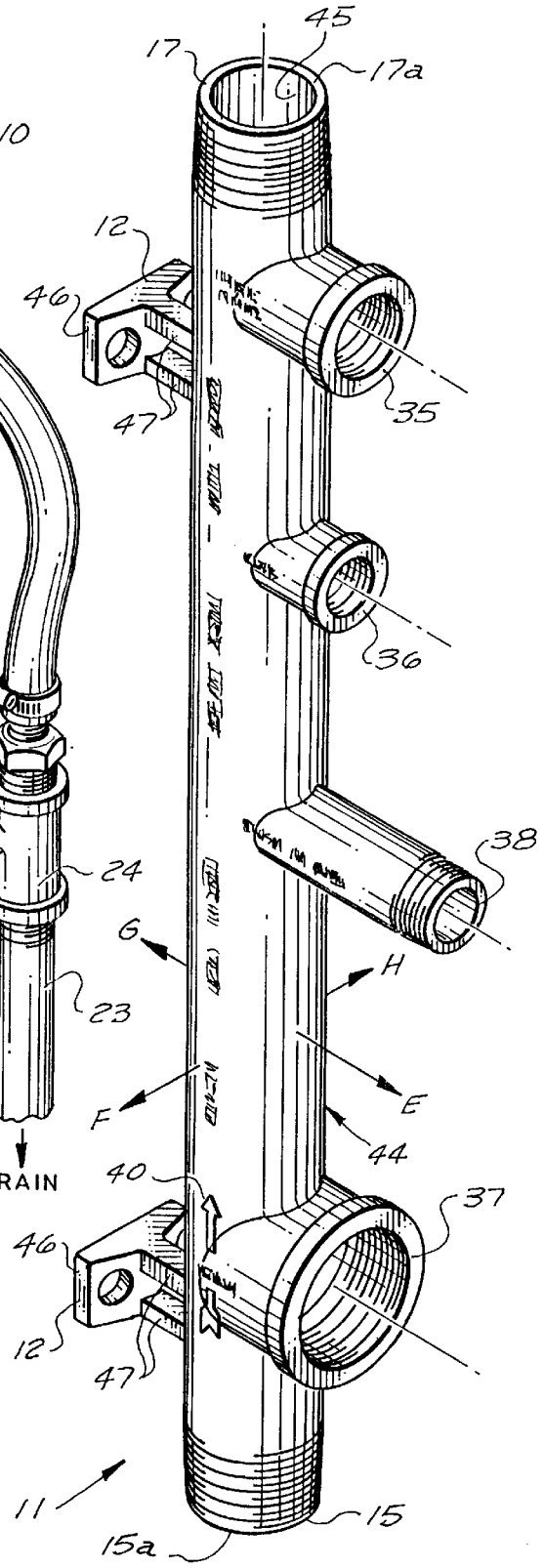
FIG. 4 is a perspective view of the preferred embodiment of the riser manifold unitary means of the present invention.

A perspective view of manifold 11 is shown in FIG. 4. The run 44 is tubular in cross-section and hollow its full length. Extending transversely (perpendicularly) from the longitudinal pipe means of run 44 and aligned in parallel relation along a first side E of run 44 are multiple pipe thread attachment means for attaching sprinkler system components to the interior 45 of run 44, such attachment means being embodied by: relief valve port 35 which has internal pipe threads sized one-half inch N.P.T.; pressure gauge port 36 which has internal pipe threads sized one-quarter inch N.P.T.; flow switch port 37 which has internal pipe threads sized one inch N.P.T.; and test and drain valve port 38 which has external pipe threads sized one-half inch N.P.T. It is noted that, although such test and drain valve ports are usually female and internal, the casting in manifold 11 of male, external threads for such port provides an efficient and direct connection to the usual test and drain valve (i.e., it saves requiring a nipple to be added to the port).

It is highly preferred that the system components be attached to the pipe thread attachments of the ports of run 44 in the following order with respect to a direction from the first end 15*a* at the pipe threads of inlet 15 to the second end 17*a* at the pipe threads of outlet 17: flow switch means; test and drain valve means; pressure gauge means; and relief valve means. Also preferred in combination, for the reasons herein, are the following dimensions: for the length of run 44, about sixteen inches; for the location of the center of port 37 for flow switch 19, about three inches from first end 15*a* of run 44; for the location of the center of port 38 for test and drain valve 20, about eight inches from first end 15*a* of run 44; for the location of the center of port 36 for pressure gauge 21, about eleven is inches from first end 15*a* of run 44;

and, for the location of the center of port 35 for relief valve 22, about fourteen inches from first end 15*a* of run 44.

The above preferred dimensions provide high efficiency in use of space, etc. The largest diameter system component is usually the pressure gauge, usually about three and one-half inches in diameter. And the system component usually having longest longitudinal extension for its port center line is the flow switch, usually about three and 11/16 inches. Furthermore, the choice of efficient hoses 30 to connect the relief valve to the drain connection of the test and drain valve is much improved by spacing the components to allow a smooth bend in hose 30, as shown in the drawings. Considering all of the above and the importance and efficiency (in cost and space) of a minimum length riser while preserving the ability to install the riser manifold for support to either side, the herein illustrated and disclosed arrangement and dimensions are an important part of the present invention, according to a preferred embodiment thereof.

Since the ports for the system components are all to one side (side E) of the manifold 11 (and of run 44), and since the support connections, as for attachment to a beam of the residence, are all on the other side (the side facing in the direction G, hereinafter sometimes called side G) of the manifold 11 (and of run 44), the manifold 11 may be connected facing either way, i.e., to a left support beam/wall or to a right support beam/wall. Furthermore, as indicated elsewhere herein, manifold 11 has indicia on both manifold "facing" sides for indicating flow direction and port identifications to a user from either side. Also, it is noted that a control means, embodied by handle 20*a*, for operation of test and drain valve 20 may be attached so that handle 20*a* is facing in the illustrated direction, i.e., on the side F of run 44, or it may alternatively be attached so that handle 20*a* is facing in the opposed direction, i.e., on the side H of run 44. Thus, the test and drain valve control means will face in a direction selected from the following: about 90 degrees from side E of run 44; and about 270 degrees from side E of run 44. And the readable face of pressure gauge 21 will preferably be attached to face in the same direction as the handle 20*a*, thus providing user accessibility in either direction of attachment of manifold 11.

Pedestals 12 are located on the side G (180 degrees from side E) of run 44 and are oriented 180 degrees from the above-mentioned system component ports, as shown. Each pedestal 12 includes a mounting flange 46 attached to the run 44 by two stand-offs 47. Also shown is the preferred positioning of the indicia port identifications 39 and arrow 40 on side F (and side H, not shown but looks like side F indicia) of run 44.

Figure 5:
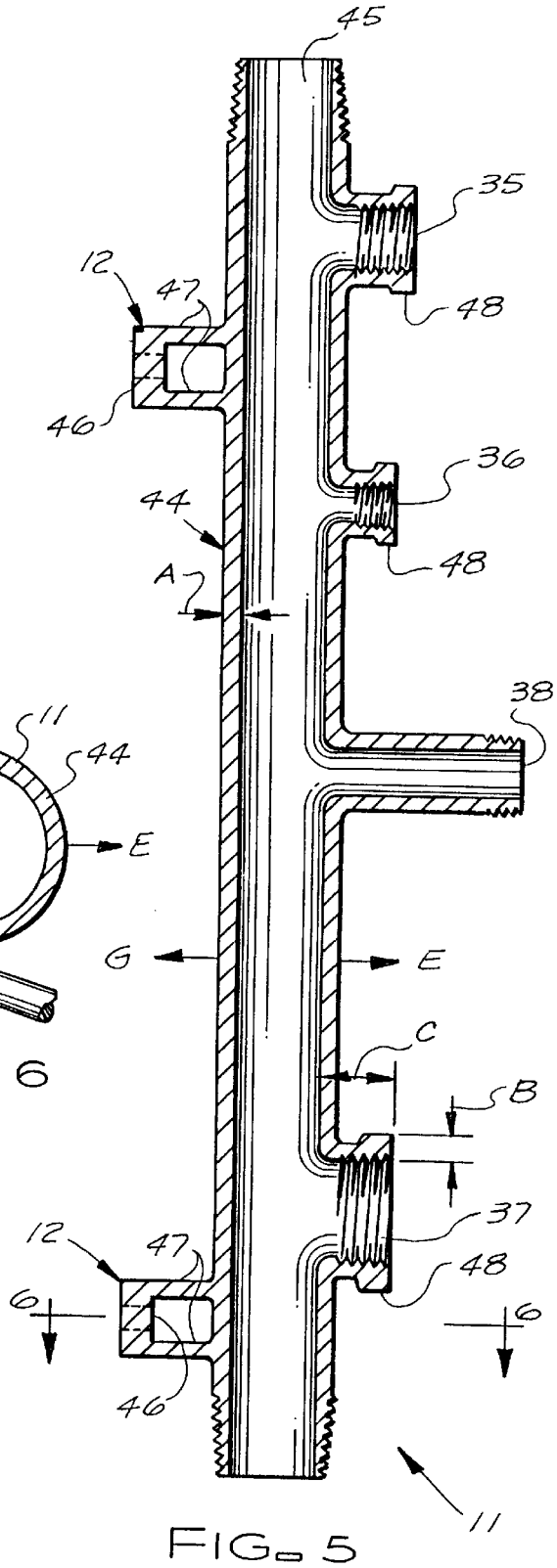
FIG. 5 is a cross-sectional elevation view of the illustrated riser manifold unitary means.

FIG. 5 shows manifold 11 in cross section its full length. Manifold 11 is preferably cast in one piece (with all of its features included in the casting) preferably of a cast alloy material selected from the following group: brass, bronze, copper. Alternatively, a suitable plastic material, for example, the material called "CPVC Orange" approved for such uses, may be used. Wall thickness "A" is generally relatively the same through-out and suitable for the water pressure used. Relief valve port 35, pressure gauge port 36 and flow switch port 37 incorporate increased wall thickness "B" as a reinforcing ring 48 giving added strength to their internal portions. Pedestal 12 mounting flanges 46 are each connected to run 44 with two stand-offs 47, for rigidity. Offset "C" of flow switch port 37 is suitably dimensioned to provide correct insertion depth of a preferred flow switch into the interior 45 of run 44 into the water flow path to allow for flow monitoring.

Figure 6:
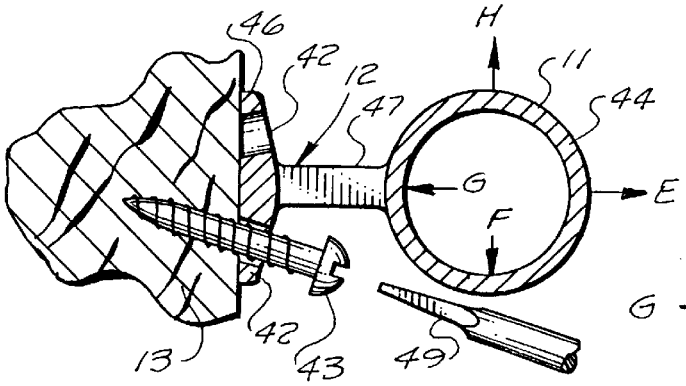
FIG. 6 is a cross-sectional view through the section 6—6 of FIG. 5.

FIG. 6 shows manifold 11 in cross section at a pedestal 12, and is typical for both pedestal locations. Mounting flange 46 is attached to run 44 with stand-offs 47. Mounting Flange 46 contains two mounting holes 42 which are each slanted away at an acute angle from a direction perpendicular to the longitudinal direction of run 44, as shown. It is preferred, especially for the illustrated relative dimensions, that such acute angle be about 20 degrees. The surface of mounting flange 46, as shown, is also tapered on the run 44 side to be approximately perpendicular to the slanted mounting holes. Screws (or bolts) 43 are then angled inward as they are tightened into their mounting location. This outward angling allows tightening of screw 43 with suitable clearance room for a screwdriver 49 (or wrench) to the side of run 44, as shown.

Figure 7:
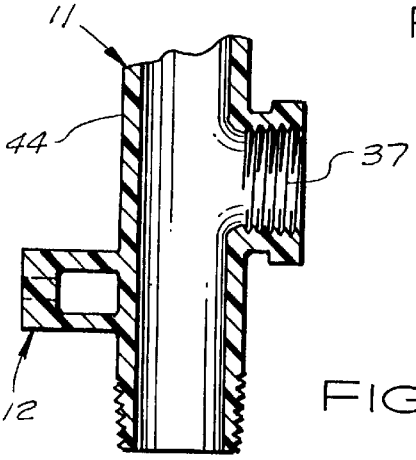
FIG. 7 is a partial cross-sectional elevation view of an alternate embodiment of the riser manifold unitary means of the present invention.

FIG. 7 is a partial cross section of manifold 11, molded of plastic as an alternate method of manufacture. Features and functions of a plastic manifold remain identical excepting any modifications necessitated by differing material strengths.

In FIG. 8, shown in an elevation view, is the lower portion of the alternate embodiment 60 of riser unit 10 which utilizes manifold 61. Manifold 61 incorporates a flanged port 62 for the mounting of flow switch 63, as an alternate to the threaded flow switch port 37 of manifold 11 and flow switch 19 as previously detailed in FIGS. 1, 2, 4, 5 and 7. The location of flanged port 62 on manifold 61 remains identical to the location of the flow switch port 37 of manifold 11. Flow switch 63, as used with the alternate embodiment 60 of riser unit 10, does not incorporate the adapter portion 50, which is shown threaded into flow switch port 37 of FIG. 2. This adapter portion 50 of the prior art incorporated 1" male pipe threads for installation to the 1" N.P.T. threaded flow switch port 37 of manifold 11, and a mounting flange 51 (see FIG. 9) compatible for attachment of the flow switch 19. The adapter portion 50 of the prior art is fully illustrated in FIG. 9 as part of adapter 66 and is represented with dotted lines. Flanged port 62 of manifold 61 includes a mounting flange 64, with some features as incorporated with the prior art adapter 66, as shown, and is designed for direct mounting of flow switch 63, as shown. Mounting flange 64 of flanged port 62 is unitarily connected to run 44 of manifold 61 with extension 65. Offset "D", the distance from the mounting face 71 of the mounting flange 64 to the center of run 44 is appropriately dimensioned to provide correct geometry of the installed flow switch 63 for accurate flow monitoring.

In the perspective exploded view of FIG. 9 are illustrated the basic components of flow switch 63 and how they install to manifold 61 at flanged port 62. The interface of flow switch 63 to the flanged port 62 of manifold 61 is mounting flange 64 which is incorporated to replace the prior art adapter 66 which is illustrated with dotted lines. Mounting flange 64 incorporates essentially the same interface mounting features as previously provided with the prior art adapter 66, which is typically the flow switch manufacturer's provided mounting means. Base plate or face plate 70 of flow switch 63 mates and secures to mounting face 71, of mounting flange 64, with screws 72, as shown. Threaded holes 73 are provided in mounting flange 64 and are appropriately sized, spaced, and oriented, to be compatible with the mounting requirements of flow switch 63. Mounting flange 64 also includes an equivalent and appropriately sized counterbore recess 74 and internal bore 75 with depths and diameters required for accepting the sensing paddle 34 and seal 76 of the flow switch 63. When mounting the flow switch 63 to the manifold 61, the flow switch 63 must first be disassembled, removing the cover 81 and switch mechanism 82 from the face plate 70. The sensing paddle 34 with seal 76 is inserted into the internal bore 75 and recess 74 of the mounting flange 64 with the sensing paddle 34 oriented perpendicular to the axis of the run 44. The face plate 70 is then installed onto the mounting face 71 of the mounting flange 64, which firmly sandwiches the seal 76 between the mounting flange 64 and the base plate 70, thus retaining the sensing paddle 34. The switch mechanism 82 may then be re-installed, electrical wiring to the switch completed, and the cover 81 re-installed, all in a straightforward manner to those with ordinary skill in the art. Thus, it is seen that the method of the present invention comprises the steps of: providing an attachment pipe extending transversely from a longitudinal pipe along a first side of such longitudinal pipe, such attachment pipe comprising, at an outer end, a flange, comprising a cylindrical counterbore co-axial with such attachment pipe, for direct no-pipe-thread attachment of a flow switch of the type illustrated to such attachment pipe in such manner that such flow switch may monitor water flow through such longitudinal pipe; providing a such disassembled such flow switch with a face plate, a sensing paddle and connector member, and a seal member; inserting such sensing paddle through such counterbore into such attachment pipe in such manner that such seal member rests essentially within such counterbore; connecting such face plate to such flange with such screw attachments in such manner as to seal such face-plate-to-flange connection with such sensing paddle in place for such monitoring and permit such connector member to pass through such face plate in position for connection to such sensing switch; reconnecting such connector member to such sensing switch; and reconnecting such housing to reassemble such flow switch. FIG. 10 is a cross-sectional elevation view of flow switch 63 installed on the flanged port 62 of manifold 61. Face plate 70 of flow switch 63 is attache to the mounting face 71 of mounting flange 64 with screws 72. The seal 76 is firmly clamped into the recess 74 of mounting flange 64 by the base plate 70 of flow switch 63. Paddle 34 of flow switch 63 thus positioned through the internal bore 75 of extension 65 and projects into the interior 45 of run 44, for sensing water flow through the manifold 61.

This last-discussed alternate preferred embodiment of this invention, using a flanged mounting, provides many advantages over a pipe-threaded mounting. E.g., it provides a simple "bolt on" mounting, not requiring large wrenches or pipe thread sealing means, such as Teflon tape or pipe dope; it eliminates an unnecessary joint; it eliminates the need for the large specialty adapter/mounting fitting which is typically supplied with the flow switch; proper orientation of the flow switch is automatically established, as the flange is permanently located; and the switch does not need to be rotated to be installed, therefore its large housing doesn't require "extra" clearance from other nearby obstructions.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A riser manifold unitary means for connecting a water supply pipe of a structure to a sprinkler system pipe of said structure comprising, in combination:

a. longitudinal pipe means for guiding water flow from said water supply pipe to said sprinkler system pipe; and b. extending transversely from said longitudinal pipe means and all aligned in parallel relation along a first side of said longitudinal pipe means, multiple attachment means for attaching sprinkler system components selected from the group consisting of i) safety components ii) test components iii) monitoring components;

c. wherein said multiple attachment means comprise pipe threads.

2. A riser manifold unitary means according to claim 1, further comprising:

a. extending transversely from said longitudinal pipe means along a second side of said longitudinal pipe means about 180 degrees opposed to said first side, support means, directly attached to said longitudinal pipe means, for assisting attachment of said riser manifold unitary means to said structure.

3. A riser manifold unitary means according to claim 1 wherein said multiple attachment means comprise ports for attachment to said longitudinal pipe means of at least three of the following said system components:

a. flow switch means for monitoring delivery of said water flow to sprinklers of said sprinkler system;

b. test and drain valve means for testing and draining said sprinkler system;

c. pressure gauge means for monitoring water pressure in said sprinkler system; and d. relief valve means for providing over-pressure relief for said sprinkler system.

4. A riser manifold unitary means according to claim 1 wherein said multiple attachment means comprise ports for attachment to said longitudinal pipe means of at least the following said system components:

a. flow switch means for monitoring delivery of said water flow to sprinklers of said sprinkler system;

b. test and drain valve means for testing and draining said sprinkler system;

c. pressure gauge means for monitoring water pressure in said sprinkler system; and d. relief valve means for providing over-pressure relief for said sprinkler system.

5. A riser manifold unitary means according to claim 1 wherein said longitudinal pipe means comprises:

a. a first pipe thread at a first end of said longitudinal pipe means for assisting connection to an inlet from said water supply pipe; and b. a second pipe thread at a second end of said longitudinal pipe means for assisting connection to an outlet to said sprinkler system pipe.

6. A riser manifold unitary means according to claim 5 wherein said multiple attachment means comprise ports for attachment to said longitudinal pipe means of the following said system components, in the following order with respect to a direction from said first pipe thread to said second pipe thread:

a. flow switch means for monitoring delivery of said water flow to sprinklers of said sprinkler system;

b. test and drain valve means for testing and draining said sprinkler system;

c. pressure gauge means for monitoring water pressure in said sprinkler system; and d. relief valve means for providing over-pressure relief for said sprinkler system.

7. A riser manifold unitary means according to claim 6 wherein a said attachment means of a said port for attachment of a said system component, test and drain valve means, comprises an external pipe thread.

8. A riser manifold unitary means according to claim 7 wherein:

a. said longitudinal pipe means is about sixteen inches long;

b. said port for said flow switch means comprises
   i. a center about three inches from said first end of said longitudinal pipe means, and
   ii. internal pipe threads sized one inch N.P.T.;

c. said port for said test and drain valve means comprises
   i. a center about eight inches from said first end of said longitudinal pipe means, and
   ii. external pipe threads sized one-half inch N.P.T.;

d. said port for said pressure gauge means comprises
   i. a center about eleven inches from said first end of said longitudinal pipe means, and
   ii. internal pipe threads sized one-quarter inch N.P.T.; and e. said port for said relief valve means comprises
   i. a center about fourteen inches from said first end of said longitudinal pipe means, and
   ii. internal pipe threads sized one-half inch N.P.T.

9. A riser manifold unitary means according to claim 7 wherein:

a. said longitudinal pipe means is about sixteen inches long;

b. said port for said flow switch means comprises
   i. a center about three inches from said first end of said longitudinal pipe means, and
   ii. flange means for direct no-pipe-thread attachment of a said flow switch means to said riser manifold unitary means;

c. said port for said test and drain valve means comprises
   i. a center about eight inches from said first end of said longitudinal pipe means, and
   ii. external pipe threads sized one-half inch N.P.T.;

d. said port for said pressure gauge means comprises
   i. a center about eleven inches from said first end of said longitudinal pipe means, and
   ii. internal pipe threads sized one-quarter inch N.P.T.; and e. said port for said relief valve means comprises
   i. a center about fourteen inches from said first end of said longitudinal pipe means, and
   ii. internal pipe threads sized one-half inch N.P.T.

10. A riser manifold unitary means according to claim 9 wherein said flange means is constructed and arranged for direct no-pipe-thread attachment of a said flow switch of the type comprising a housing including a face plate, a sensing switch within said housing, a sensing paddle outside said housing and connected by a connector member through said face plate to said sensing switch, screw attachments for connecting said face plate to a flange member, and a cylindrical seal member, co-axial with said sensing paddle and encircling said connector member, for sealing said face-plate-to-flange-member connection.

11. A riser manifold unitary means according to claim 8 wherein said riser manifold unitary means is constructed essentially of a material selected from the following group:

a. a brass cast alloy;

b. a bronze cast alloy;

c. a copper cast alloy;

d. a molded plastic.

12. A riser manifold unitary means according to claim 1 further comprising:

a. at about 90 degrees from said first side of said longitudinal pipe means, first indicia indicating a water flow direction and second indicia indicating port identifications; and b. at about 270 degrees from said first side of said longitudinal pipe means, third indicia indicating a water flow direction and fourth indicia indicating port identifications;

c. said indicia comprising symbols raised above a surface level of said riser manifold unitary means.

13. A riser manifold unitary means according to claim 2 wherein said support means comprises pedestal means including mounting flange means comprising a mounting hole for assisting attachment of said unitary means to said structure.

14. A riser manifold unitary means according to claim 13 wherein said mounting hole is slanted away at an acute angle from a direction perpendicular to said longitudinal pipe means.

15. A riser manifold unitary means according to claim 14 wherein said acute angle is about 20 degrees.

16. A riser manifold unitary means according to claim 1 further comprising:

a. extending transversely from said longitudinal pipe means and aligned in parallel relation along said first side of said longitudinal pipe means, flow switch attachment means for attaching a flow switch.

17. A riser manifold unitary means according to claim 16 wherein said flow switch attachment means comprises flange means for direct no-pipe-thread attachment of a said flow switch to said riser manifold unitary means.

18. A riser manifold unitary means according to claim 17 wherein said flange means is constructed and arranged for direct no-pipe-thread attachment of a said flow switch of the type comprising a housing including a face plate, a sensing switch within said housing, a sensing paddle outside said housing and connected by a connector member through said face plate to said sensing switch, screw attachments for connecting said face plate to a flange member, and a cylindrical seal member, co-axial with said sensing paddle and encircling said connector member, for sealing said face-plate-to-flange-member connection.

19. A sprinkler system riser according to claim 3 further comprising:

I. extending transversely from said longitudinal pipe means along a second side of said longitudinal pipe means about 180 degrees opposed to said first side, support means for assisting attachment of said riser manifold unitary means to said structure;

ii. wherein said support means comprises pedestal means including mounting flange means comprising a mounting hole for assisting attachment of said unitary means to said structure.

20. A sprinkler system riser according to claim 19 wherein:

a. said mounting hole is slanted about twenty degrees away from a direction perpendicular to said longitudinal pipe means.

21. A sprinkler system riser according to claim 20 wherein:

a. a control means for operation of said test and drain valve means is facing a direction selected from the following:

I. about 90 degrees from said first side of said longitudinal pipe means, and ii. about 270 degrees from said first side of said longitudinal pipe means; and b. a readable face of said pressure gauge means is facing in the same direction as said control means.

22. A riser manifold unitary means according to claim 1 wherein said multiple attachment means comprise ports for attachment to said longitudinal pipe means of at least three of the following said system components, in the following order with respect to a direction from said first pipe thread to said second pipe thread:

a. flow switch means for monitoring delivery of said water flow to sprinklers of said sprinkler system;

b. test and drain valve means for testing and draining said sprinkler system;

c. pressure gauge means for monitoring water pressure in said sprinkler system; and d. relief valve means for providing over-pressure relief for said sprinkler system.

23. A riser manifold unitary means according to claim 22 wherein:

a. said port for said flow switch means comprises

I. a center about three inches from said first end of said longitudinal pipe means, and ii. internal pipe threads suitably sized;

b. said port for said test and drain valve means comprises

I. a center about eight inches from said first end of said longitudinal pipe means, and ii. external pipe threads suitably sized;

c. said port for said pressure gauge means comprises

I. a center about eleven inches from said first end of said longitudinal pipe means, and ii. internal pipe threads suitably sized.

24. A riser manifold unitary means according to claim 22 wherein said port for said flow switch means comprises flange means for direct no-pipe-thread attachment of a said flow switch means to said riser manifold unitary means.

25. A sprinkler system riser unit for supplying water from a water supply pipe of a structure to a sprinkler system pipe of said structure comprising, in combination:

a. a riser manifold unitary means comprising i. longitudinal pipe means for guiding water flow from said water supply pipe to said sprinkler system pipe;

ii. extending transversely from said longitudinal pipe means and all aligned in parallel relation along a first side of said longitudinal pipe means, multiple attachment means for attaching sprinkler system components;

iii. at about 90 degrees from said first side of said longitudinal pipe means, first indicia indicating a water flow direction and second indicia indicating port identifications;

iv. at about 270 degrees from said first side of said longitudinal pipe means, third indicia indicating a water flow direction and fourth indicia indicating port identifications;

v. a first pipe thread at a first end of said longitudinal pipe means for assisting connection to an inlet from said water supply pipe; and vi. a second pipe thread at a second end of said longitudinal pipe means for assisting connection to an outlet to said sprinkler system pipe; and b. attached to said attachment means of said riser manifold unitary means, in the following order with respect to a direction from said first pipe thread to said second pipe thread, the following said sprinkler system components:

i. flow switch means for monitoring delivery of said water flow to sprinklers of said sprinkler system;

ii. test and drain valve means for testing and draining said sprinkler system;

iii. pressure gauge means for monitoring water pressure in said sprinkler system; and iv. relief valve means for providing over-pressure relief for said sprinkler system.

26. A sprinkler system riser according to claim 25 wherein said attachment means comprises pipe threads.

27. A sprinkler system riser according to claim 26 wherein said attachment means to said flow switch means comprises flange means for direct no-pipe-thread attachment.

28. A sprinkler system riser according to claim 25 further comprising:

a. drain connection means attached to said test and drain valve means; and b. a drain hose attached from a first hose attachment means of said relief valve means to a second hose attachment means of said drain connection means;

c. wherein said first and second hose attachment means comprise external-barb-type nipples.

29. A sprinkler system riser according to claim 28 further comprising:

i. extending transversely from said longitudinal pipe means along a second side of said longitudinal pipe means about 180 degrees opposed to said first side, support means for assisting attachment of said riser manifold unitary means to said structure;

ii. wherein said support means comprises pedestal means including mounting flange means comprising a mounting hole for assisting attachment of said unitary means to said structure.

30. A sprinkler system riser according to claim 29 further comprising:

a. inlet means connected to said first pipe thread at said first end of said longitudinal pipe means;

b. outlet means connected to said second pipe thread at said second end of said longitudinal pipe means;

c. drain means connected to said drain connection means; and d. structure connection means connecting said mounting hole to said structure.

31. A sprinkler system riser according to claim 30 wherein:

a. said mounting hole is slanted about twenty degrees away from a direction perpendicular to said longitudinal pipe means.

32. A sprinkler system riser according to claim 30 wherein:

a. a control means for operation of said test and drain valve means is facing a direction selected from the following:

i. about 90 degrees from said first side of said longitudinal pipe means, and ii. about 270 degrees from said first side of said longitudinal pipe means; and b. a readable face of said pressure gauge is facing in the same direction as said control means.

33. A riser manifold unitary means for connecting a water supply pipe of a structure to a sprinkler system pipe of said structure comprising, in combination:

a. longitudinal pipe means for guiding water flow from said water supply pipe to said sprinkler system pipe;

b. extending transversely from said longitudinal pipe means and aligned in parallel relation along a first side of said longitudinal pipe means, multiple attachment means for attaching sprinkler system components;

c. extending transversely from said longitudinal pipe means along a second side of said longitudinal pipe means opposite to said first side, support means for assisting attachment of said riser manifold unitary means to said structure;

d. at about 90 degrees from said first side of said longitudinal pipe means, first indicia indicating a water flow direction and second indicia indicating port identifications;

e. at about 270 degrees from said first side of said longitudinal pipe means, third indicia indicating a water flow direction and fourth indicia indicating port identifications;

f. wherein said indicia comprise symbols raised above a surface level of said riser manifold unitary means;

g. a first pipe thread at a first end of said longitudinal pipe means for assisting connection to an inlet from said water supply pipe;

h. a second pipe thread at a second end of said longitudinal pipe means for assisting connection to an outlet to said sprinkler system pipe;

i. wherein said multiple attachment means provide ports for attachment to said longitudinal pipe means of the following said system components, in the following order with respect to a direction from said first pipe thread to said second pipe thread, i. flow switch means for monitoring delivery of said water flow to sprinklers of said sprinkler system;

ii. test and drain valve means for testing and draining said sprinkler system;

iii. pressure gauge means for monitoring water pressure in said sprinkler system; and iv. relief valve means for providing over-pressure relief for said sprinkler system;

j. wherein said multiple attachment means comprises a male pipe thread for attachment to said test and drain valve means;

k. wherein said support means comprises pedestal means including mounting flange means comprising a mounting hole for assisting attachment of said unitary means to said structure; and l. wherein said mounting hole is slanted about twenty degrees away from a direction perpendicular to said longitudinal pipe means.

34. A riser manifold unitary means according to claim 33 wherein:

a. said longitudinal pipe means is about sixteen inches long;

b. said first and second pipe threads are external pipe threads;

c. said port for said flow switch means comprises i. a center about three inches from said first end of said longitudinal pipe means, and ii. internal pipe threads sized one inch N.P.T.;

d. said port for said test and drain valve means comprises i. a center about eight inches from said first end of said longitudinal pipe means, and ii. external pipe threads sized one-half inch N.P.T.;

e. said port for said pressure gauge means comprises i. a center about eleven inches from said first end of said longitudinal pipe means, and ii. internal pipe threads sized one-quarter inch N.P.T.; and f. said port for said relief valve means comprises i. a center about fourteen inches from said first end of said longitudinal pipe means, and ii. internal pipe threads sized one-half inch N.P.T.

35. A riser manifold unitary means according to claim 33 wherein:

a. said longitudinal pipe means is about sixteen inches long;

b. said first and second pipe threads are external pipe threads;

c. said port for said flow switch means comprises i. a center about three inches from said first end of said longitudinal pipe means, and ii. flange means for direct no-pipe-thread attachment of said flow switch means to said riser manifold unitary means;

d. said port for said test and drain valve means comprises i. a center about eight inches from said first end of said longitudinal pipe means, and ii. external pipe threads sized one-half inch N.P.T.;

e. said port for said pressure gauge means comprises i. a center about eleven inches from said first end of said longitudinal pipe means, and ii. internal pipe threads sized one-quarter inch N.P.T.; and f. said port for said relief valve means comprises i. a center about fourteen inches from said first end of said longitudinal pipe means, and ii. internal pipe threads sized one-half inch N.P.T.

36. A riser manifold unitary means according to claim 33 wherein said riser manifold unitary means is constructed essentially of a molded plastic material.

37. A riser manifold unitary means for connecting a water supply pipe of a structure to a sprinkler system pipe of said structure comprising, in combination:

a. longitudinal pipe means, attachable to said water supply pipe, for guiding water flow from said water supply pipe to said sprinkler system pipe; and b. extending transversely from said longitudinal pipe means along a first side of said longitudinal pipe means, attachment means for attaching flow switch means for monitoring delivery of said water flow to sprinklers of said sprinkler system;

c. wherein said attachment means comprises flange means for direct no-pipe-thread attachment of said flow switch means to said riser manifold unitary means.

38. A riser manifold unitary means according to claim 37 wherein said flange means comprises:

a. multiple hole means for providing attachment sites for a said flow switch means; and b. counterbore means for receiving a seal for said direct no-pipe-means attachment of said flow switch means to said riser manifold means.

39. In a structure for containing water flow:

a. longitudinal pipe means for guiding said water flow; and b. extending transversely from said longitudinal pipe means along a first side of said longitudinal pipe means, attachment means for attaching flow monitoring means for monitoring said water flow;

c. wherein such attachment means comprises flange means for direct no-pipe-thread attachment of said flow monitoring means to said longitudinal pipe means;

d. wherein said flange means comprises an attachment pipe extending transversely from said longitudinal pipe means along a first side of said longitudinal pipe means, said attachment pipe comprising, at an outer end of said attachment pipe, a flange, said flange I. comprising a cylindrical counterbore co-axial with said attachment pipe, and ii. being constructed and arranged for assisting direct no-pipe-thread attachment of said flow switch to said attachment pipe in such manner that said flow switch may monitor water flow through said longitudinal pipe means.

40. A sprinkler system riser unit for supplying water from a water supply pipe of a structure to a sprinkler system pipe of said structure comprising, in combination:

a. a riser manifold unitary means comprising

I. longitudinal pipe means for guiding water flow from said water supply pipe to said sprinkler system pipe;

ii. extending transversely from said longitudinal pipe means and all aligned in parallel relation along a first side of said longitudinal pipe means, multiple attachment means for attaching sprinkler system components;

iii. at about 90 degrees from said first side of said longitudinal pipe means, first indicia indicating a water flow direction and second indicia indicating port identifications;

iv. at about 270 degrees from said first side of said longitudinal pipe means, third indicia indicating a water flow direction and fourth indicia indicating port identifications;

v. a first pipe thread at a first end of said longitudinal pipe means for assisting connection to an inlet from said water supply pipe; and vi. a second pipe thread at a second end of said longitudinal pipe means for assisting connection to an outlet to said sprinkler system pipe; and b. attached to said attachment means of said riser manifold unitary means, in the following order with respect to a direction from said first pipe thread to said second pipe thread, at least three of the following said sprinkler system components:

I. flow switch means for monitoring delivery of said water flow to sprinklers of said sprinkler system;

ii. test and drain valve means for testing and draining said sprinkler system;

iii. pressure gauge means for monitoring water pressure in said sprinkler system; and iv. relief valve means for providing over-pressure relief for said sprinkler system.

41. A riser manifold unitary means for connecting a water supply pipe of a structure to a sprinkler system pipe of said structure comprising, in combination:

a. longitudinal pipe means for guiding water flow from said water supply pipe to said sprinkler system pipe;

b. extending transversely from said longitudinal pipe means and aligned in parallel relation along a first side of said longitudinal pipe means, multiple attachment means for attaching sprinkler system components;

c. extending transversely from said longitudinal pipe means along a second side of said longitudinal pipe means opposite to said first side, support means for assisting attachment of said riser manifold unitary means to said structure;

d. at about 90 degrees from said first side of said longitudinal pipe means, first indicia indicating a water flow direction and second indicia indicating port identifications;

e. at about 270 degrees from said first side of said longitudinal pipe means, third indicia indicating a water flow direction and fourth indicia indicating port identifications;

f. wherein said indicia comprise symbols raised above a surface level of said riser manifold unitary means;

g. a first pipe thread at a first end of said longitudinal pipe means for assisting connection to an inlet from said water supply pipe;

h. a second pipe thread at a second end of said longitudinal pipe means for assisting connection to an outlet to said sprinkler system pipe;

I. wherein said multiple attachment means provide ports for attachment to said longitudinal pipe means of at least three of the following said system components, in the following order with respect to a direction from said first pipe thread to said second pipe thread, I. flow switch means for monitoring delivery of said water flow to sprinklers of said sprinkler system;

ii. test and drain valve means for testing and draining said sprinkler system;

iii. pressure gauge means for monitoring water pressure in said sprinkler system; and iv. relief valve means for providing over-pressure relief for said sprinkler system;

j. wherein said multiple attachment means comprises a male pipe thread for attachment to said test and drain valve means;

k. wherein said support means comprises pedestal means including mounting flange means comprising a mounting hole for assisting attachment of said unitary means to said structure; and l. wherein said mounting hole is slanted about twenty degrees away from a direction perpendicular to said longitudinal pipe means.

* * * * *